US006199571B1

(12) United States Patent
Lin et al.

(10) Patent No.: US 6,199,571 B1
(45) Date of Patent: Mar. 13, 2001

(54) LIGHTENING MULTIPLE-FOLD AUTOMATIC UMBRELLA WITH CONTROL MODULE

(75) Inventors: Chung-Kuang Lin; Jung-Jen Chang, both of Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 0 days.

(21) Appl. No.: 09/259,583

(22) Filed: Mar. 1, 1999

(51) Int. Cl.[7] ..... A45B 25/14

(52) U.S. Cl. ..... 135/24; 135/22; 135/25.1; 135/20.3

(58) Field of Search ..... 135/24, 22, 25.1, 135/20.3

(56) References Cited

U.S. PATENT DOCUMENTS 5,060,684 * 10/1991 Wu ..... 135/25.41
5,144,969 * 9/1992 Chou et al. ..... 135/22
5,275,186 * 1/1994 Liu ..... 135/24
5,492,140 * 2/1996 Lin et al. ..... 135/24
5,588,454 * 12/1996 Kou ..... 135/24
5,626,160 * 5/1997 Ko ..... 135/22
5,626,161 * 5/1997 Lin et al. ..... 135/24
5,632,290 * 5/1997 Ling Kuo ..... 135/24
5,645,094 * 7/1997 Wun ..... 135/24
5,791,359 * 8/1998 Lin et al. ..... 135/24
5,803,102 * 9/1998 Ko ..... 135/24
5,823,214 * 10/1998 Seidel ..... 135/22
5,868,151 * 2/1999 Kuo ..... 135/24
5,992,433 * 11/1999 Chung-kuang et al. ..... 135/24
6,016,822 * 1/2000 Lin et al. ..... 135/24

* cited by examiner

*Primary Examiner*—Robert Canfield
(74) *Attorney, Agent, or Firm*—Dougherty & Troxell

(57) ABSTRACT

A lightening multiple-fold automatic umbrella comprises: a central shaft consisting of a plurality of tubes telescopically engageable with one another; a rib assembly having at least a top rib and a stretcher rib pivotally secured to an upper notch on the central shaft and a lower runner slidably held on the central shaft for securing an umbrella cloth on the rib assembly; an opening spring retained within the central shaft for opening the umbrella; a drag rope retained between the central shaft and the lower runner for pulling the lower runner as upwardly moved when opening the umbrella and extending the rib assembly; and a control module embedded in a grip of the central shaft normally locking the lower runner when closing the umbrella for folding the rib assembly; and operatively unlocking the lower runner when opening the umbrella for extending the rib assembly. By these mechanisms, a multiple-fold automatic umbrella will be produced for quick assembly and convenient operation or maintenance.

2 Claims, 4 Drawing Sheets

LIGHTENING MULTIPLE-FOLD AUTOMATIC UMBRELLA WITH CONTROL MODULE

BACKGROUND OF THE INVENTION

U.S. Pat. No. 5,791,359 granted to the same inventors of this application disclosed a multiple-fold automatic umbrella having lightening umbrella structure, which however requires an elongate control lever (52) to be pivotally mounted in the grip (12) by a pivot (521), thereby causing a complex and inconvenient assembly of the elements of the control means (5). Meanwhile, the link (41) of the drag means (4) should be secured in a link holder (42) by a pin (422) and the link holder (42) is further secured in a lower portion of the lower tube (11) of the central shaft (1), thereby causing inconvenience and complexity for assembling the elements of the umbrella.

U.S. Pat. No. 4,682,616 to Schultes disclosed an umbrella with a mechanism for locking and releasing a slider including a bolt (18) slidably carried in the handle (1) and a release button (15) secured to the bolt (18). As shown in FIG. 7 of the Schultes patent (,616), the handle (1) should be separated into a bottom part and a top part, with the two detachable parts provided to define the slide channel **(1*a*") and to mount the bolt (18) and the spring (17) therebetween to be easily accessible. However, such two parts when combined for assembling the complete handle (1) will form a "boundary line" at their connection edges, thereby influencing an esthetic decorative effect for the umbrella. The hook portion of the top part engageable and combinable with the groove of the bottom part of the handle should each be made by plastic material (dotted line shown in FIG. 7 of Schultes patent), not suitably made by wooden material. It may therefore be difficult to make the handle (1)** of the umbrella by wooden material and the handle as made of plastic material may decrease its commercial value and ornamental effect in consideration of the noble feeling as enabled by wooden material.

The present inventors have found the drawbacks of the conventional multiple-fold automatic umbrella, and invented the present lightening multiple-fold automatic umbrella.

SUMMARY OF THE INVENTION

The object of the present invention is to provide a lightening multiple-fold automatic umbrella comprising: a central shaft consisting of a plurality of tubes telescopically engageable with one another; a rib assembly having at least a top rib and a stretcher rib pivotally secured to an upper notch on the central shaft and a lower runner slidably held on the central shaft for securing an umbrella cloth on the rib assembly; an opening spring retained within the central shaft for opening the umbrella; a drag rope retained between the central shaft and the lower runner for pulling the lower runner as upwardly moved when opening the umbrella and extending the rib assembly; and a control module embedded in a grip of the central shaft normally locking the lower runner when closing the umbrella for folding the rib assembly; and operatively unlocking the lower runner when opening the umbrella for extending the rib assembly, thereby providing a multiple-fold automatic umbrella for quick assembly and convenient operation or maintenance.

DETAILED DESCRIPTION

Figure 1:
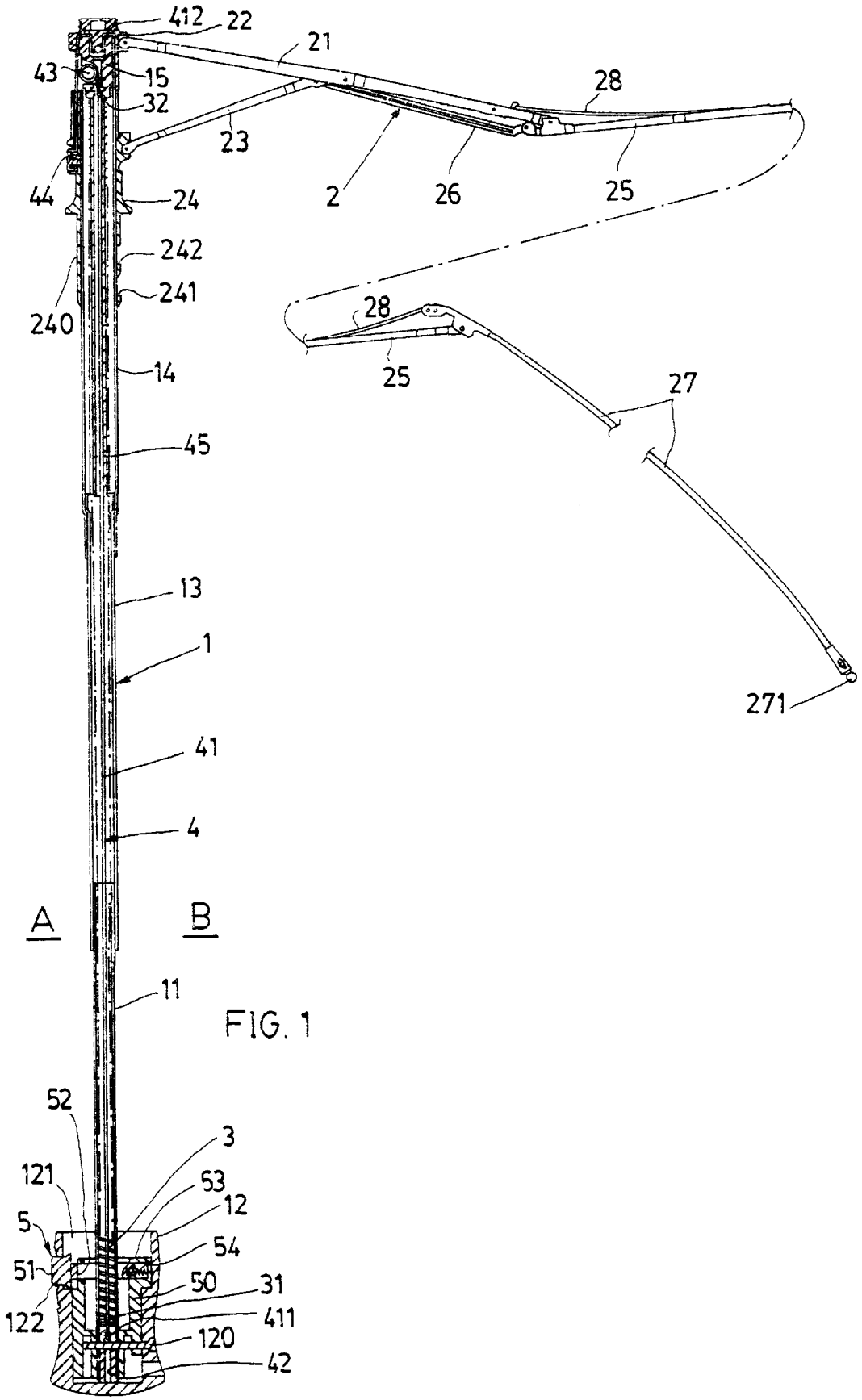
FIG. 1 is an illustration showing an opening umbrella of the present invention.

As shown in FIGS. 1~7, the multiple-fold automatic umbrella of the present invention comprises: a central shaft 1, a rib assembly 2, an opening spring 3, a drag means 4, and a control module 5.

The present invention is provided for triple-fold automatic umbrella as shown in the drawing figures as accompanied herewith. However, the number of folds of the umbrella are not limited in the present invention.

The central shaft 1 includes: a lower tube 11 having a grip 12 secured to a lower portion of the lower tube 11, a middle tube 13 telescopically engageable with the lower tube 11, an upper tube 14 telescopically engageable with the middle tube 13, and an inner block 15 fixed in an upper portion of the upper tube 14.

The shapes of the tubes 14, 13, 11 are not limited in this invention. Every two neighboring tubes may be formed with coupling or limiting mechanism between the two tubes to prevent "escape" or separation of one tube from the other. For lightening purpose, the tube may be made of aluminum alloy or other light materials having a cross section of concave hexagonal sides.

The rib assembly 2 includes: a top rib 21 pivotally secured to an upper notch 22 formed on an upper portion of the central shaft 1, a stretcher rib 23 pivotally secured between the top rib 21 and a lower runner 24 slidably hold on central shaft 1, an intermediate rib 25 pivotally connected to the top rib 21 and having an intermediate connecting rib 26 pivotally connected between the stretcher rib 23 and the intermediate rib 25, a tail rib 27 pivotally connected to the intermediate rib 25, and a spring rib 28 connected between the top rib 21 and the tail rib 27. Each tail rib 27 has a ball tip 271 formed on an outermost end of the rib 27.

The ribs of the rib assembly 2 may be modified to be other multiple-fold structures, not limited in the present invention.

The lower runner 24 includes a lower extension tube 240 protruding downwardly from the lower runner 24, having a first engaging hole 241 formed in a lowermost end portion of the lower extension tube 240, and a second engaging hole 242 formed in the lower extension tube 240 and positioned above the first engaging hole 241, each engaging hole 241, 242 engageable with a sliding latch 52 slidably held in the control module 5.

The opening spring 3 has a lower spring end 31 retained on a rope holder 42 of the drag means 4 and retained in a lower portion of the lower tube 11; and an upper spring end 32 retained on the inner block 15 secured in an upper portion of the upper tube 14.

The drag means 4 includes: a rope 41 having a lower rope end 411 secured in a rope holder 42 fixed within a lower portion of the lower tube 11, an upper roller 43 rotatably held in an upper portion of the upper tube 14, a lower roller 44 rotatably mounted on the lower runner 24, and an inner sleeve 45 disposed in the upper tube 14 and secured to an upper portion of the upper tube 14 for slidably disposing the opening spring 3 about the inner sleeve 45. The rope 41 is directed upwardly from the lower rope end 411 through the inner sleeve 45 to be wound on the upper roller 43, and then deflected downwardly to be wound on the lower runner 44, and finally deflected upwardly to have an upper rope end 412 fixed in an upper end or in the inner block 15 of the upper tube 14.

The rope holder 42 of the drag means 4 is secured in a bottom portion of the lower tube 11 by a fastening device 120 which may be a screw, a nail or a pin inserted transversely through the grip 12 for simultaneously fixing the lower tube 11 and a latch holder 53 of the control module 5 within the grip 12; having a socket 421 formed in the rope holder 42 for passing the lower rope end 411 of the rope 41 through the rope holder 42 to be tied as a knot to be locked within the socket 421 in the rope holder 42. Such a knot of the lower rope end 411 of the rope 41 may be quickly secured in the rope holder 42 for easily assembling the umbrella of the present invention.

The control module 5 includes: a push button 51 slidably held in a button hole 122 formed through the grip 12 adjacent to a first side A of the central shaft 1, a sliding latch 52 slidably held in a latch holder 53 embedded in an interior 121 recessed in the grip 12, and a restoring spring 54 resiliently retained between the sliding latch 52 and the latch holder 53 adjacent to a second side B of the shaft 1 for normally urging the sliding latch 52 and the push button 51 resiliently contacted with the sliding latch 52 to protrude the push button 51 outwardly towards the first side A from the button hole 122 of the grip 12 ready for a depression thereon when opening the umbrella.

The push button 51 has an extension disk 511 formed on an inner end of the button 51 to be resiliently contacted with the sliding latch 52, with the extension disk 511 outwardly retarded on an inside wall around the button hole 122 of the grip 12 when resiliently urged towards the first side A of the shaft 1 by the sliding latch 52 as restored by the restoring spring 54.

The sliding latch 52 is reciprocatively slidably engageable with a sliding hole 531 transversely formed in an upper portion of the latch holder 53, having an oval-shaped hole 521 longitudinally formed through a central portion of the sliding latch 52 with the oval-shaped hole 521 slightly larger than an outside diameter of the lower extension tube 240 of the lower runner 24, and a latch portion 522 formed on an edge portion of the oval-shaped hole 521 adjacent to the second side B of the shaft 1 and tapered downwardly towards the central portion of the latch 52 to be engageable with either engaging hole 241, 242 in the lower runner 24 when closing the umbrella.

The latch holder 53 includes: a sliding hole 531 transversely formed in an upper end portion of a sleeve member 50 to be slidably engageable with the sliding latch 52 within the sliding hole 531, a restoring spring 54 retained in an inside portion of the sliding hole 531 adjacent to the second side B of the shaft 1 to urge the latch 52 and push button 51 outwardly towards the first side A of the shaft 1, a central hole 532 longitudinally formed in a central portion of the latch holder 53, allowing a downward movement of the lower extension tube 240 of the lower runner 24 and the tubes 14, 13 of the central shaft 1 for engaging each engaging hole 241, 242 in the lower runner 24 with the latch portion 522 formed on the sliding latch 52 when closing the umbrella; with the sleeve member 50 embedded in the interior 121 in the grip 12 and disposed about a bottom portion of the lower tube 11 and fixed in the grip by a fastening device 120 which may be a screw, a nail or a pin.

Figure 2:
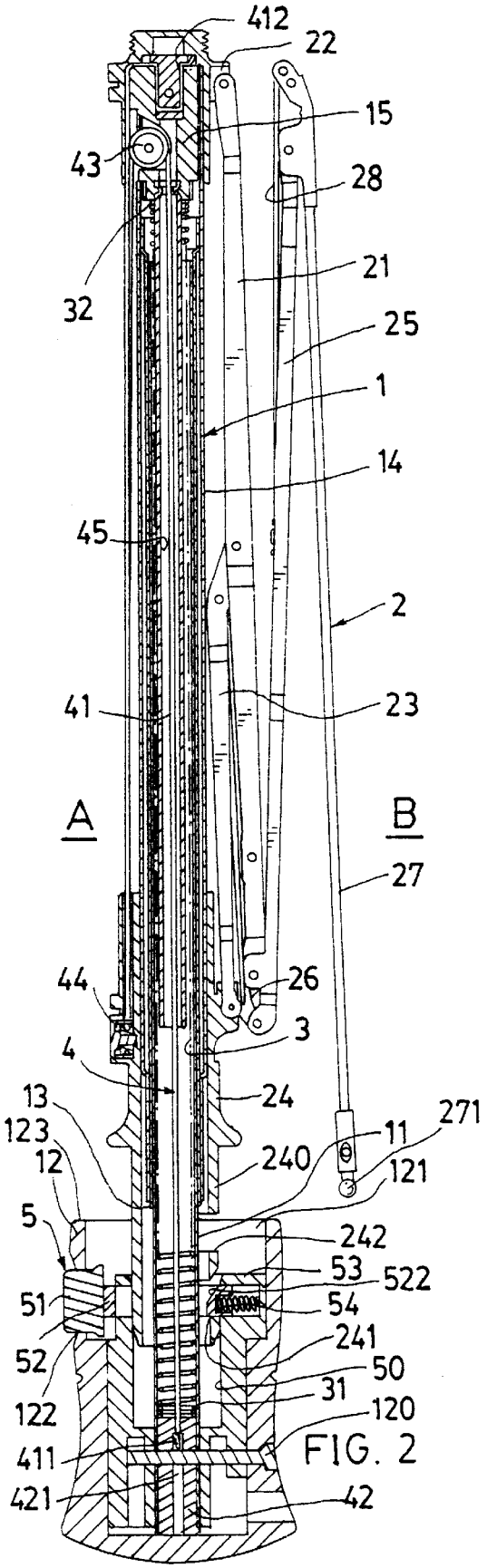
FIG. 2 is a sectional drawing of the present invention when closed.
Figure 3:
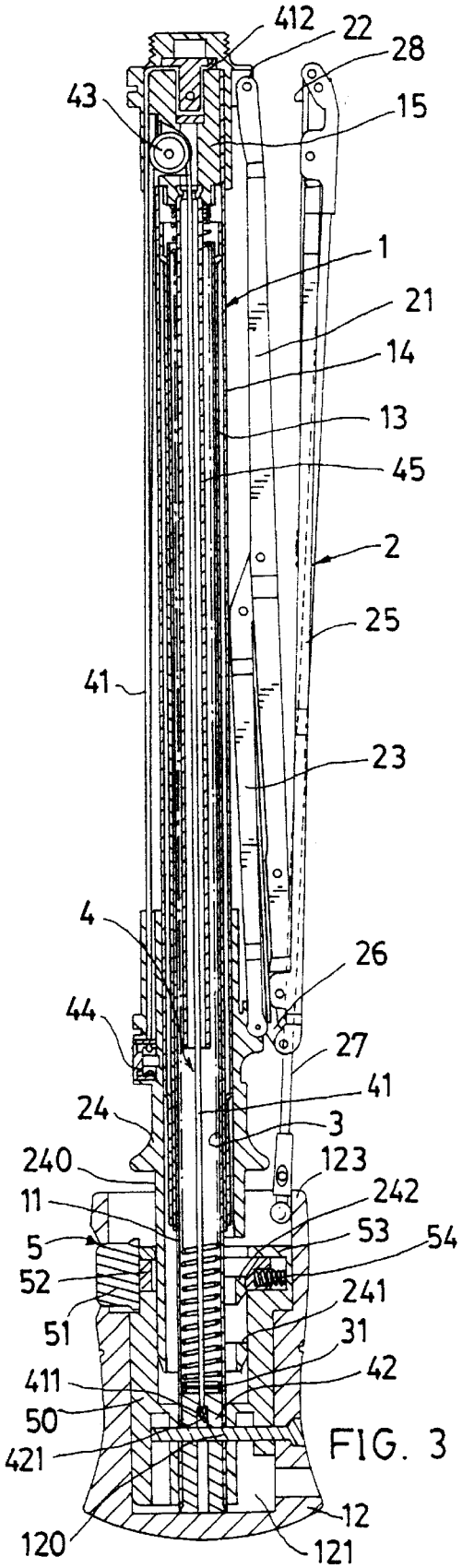
FIG. 3 is an illustration showing an intermediate step for receiving the ball tips of the umbrella ribs within a top periphery of the grip.
Figure 4:
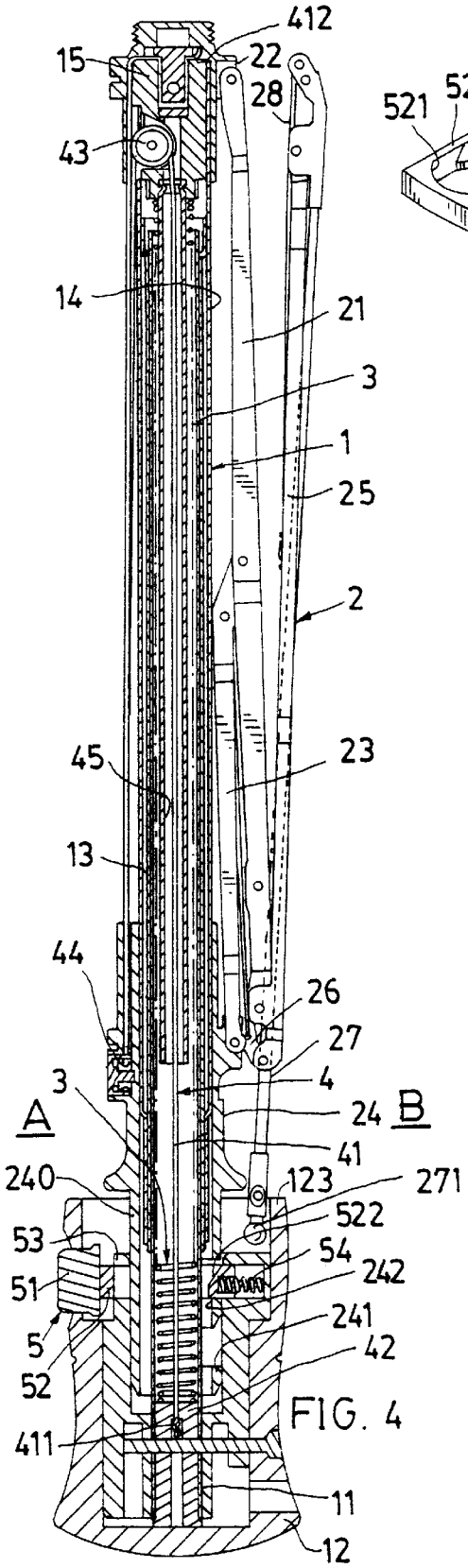
FIG. 4 shows a folded umbrella following the step as shown in FIG. 3.
Figure 5:
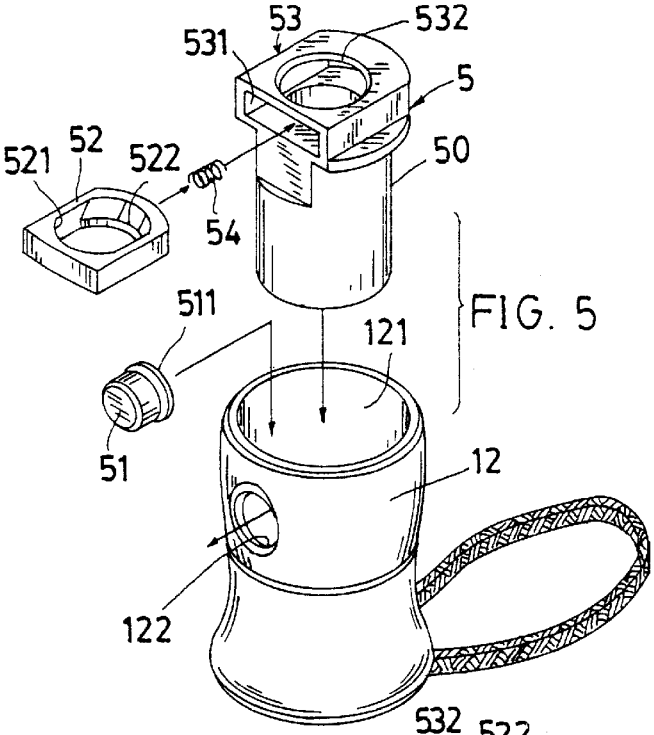
FIG. 5 is a perspective exploded view of the control module and the grip of the present invention.
Figure 6:
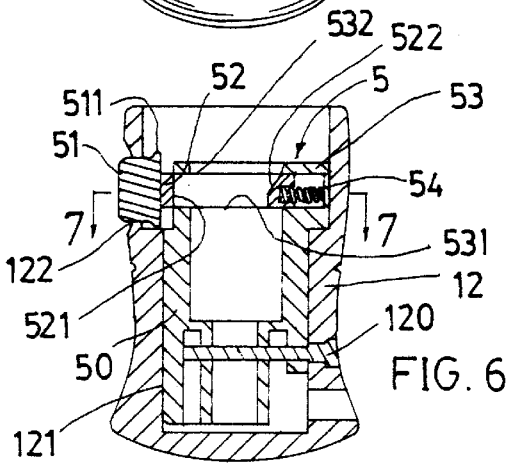
FIG. 6 is a sectional drawing when embedding the control module into the grip of the present invention following FIG. 5.
Figure 7:
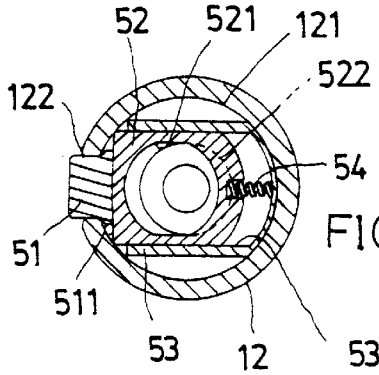
FIG. 7 is a cross sectional drawing of the grip when viewed from 7—7 direction of FIG. 6.

When closing the opened umbrella as shown in FIG. 1, the lower runner 24 is pulled downwardly to retract the rib assembly 2 to engage the first engaging hole 241 in the lower runner 24 with the latch portion 522 of the sliding latch 52 as shown in FIG. 2, the ball tips 271 are still remained at outside of the top periphery 123 of the grip 12. The ball tips 271 may be further retracted towards the shaft 1 and the grip 12 may also be further depressed towards the shaft in order to receive the ball tops 271 within the periphery 123 of the grip and the lower extension tube 240 of the runner 24 is simultaneously retracted into the interior 121 of the grip to engage the second engaging hole 242 on the runner 24 with the latch portion 522 as shown in FIGS. 3, 4 to finally fold the umbrella more stably. The total length of the folded umbrella of this invention can thus be further shortened (FIG. 4) for making a mini compact foldable umbrella.

Upon depression of push button 51 to disengage the second engaging hole 242 of the runner 24 from the latch portion 522 of the sliding latch 52, the opening spring 3 will urge the tubes 14, 13 of the central shaft 1 upwardly, and raise the runner 24 to extend the rib assembly 2 for opening the umbrella from FIG. 4 to FIG. 1. The ball tips 271 seem to be obstructed by the periphery 123 of the grip 12 as shown in FIG. 4. Undoubtedly, the spring force of the opening spring 3 for extending the tubes 14, 13 of the shaft 1 and the ribs of the rib assembly 2 will instantly "pull" the tips 271 outwardly to "escape" from the periphery 123 of the grip 12, thereby causing no influence for a smooth opening of the umbrella of the present invention.

The control module 5 of the present invention is formed as a "module" easily inserted, embedded, assembled in the grip or easily dismantled from the grip, simplifying the production of a lightening multiple-fold automatic umbrella.

The rope holder 42 of the drag means 4 is directly inserted in an interior at a bottom portion of the lower tube within the grip 12, thereby efficiently saving the volume for accommodating such a rope holder 42 in such a "tiny" grip adapted for miniaturizing a compact folding umbrella.

The simplified structure for making the control means to be a "module" as taught by this application will facilitate the production of a multiple-fold automatic umbrella and will help a well maintenance of the umbrella, thereby being superior to the prior arts.

Figure 8:
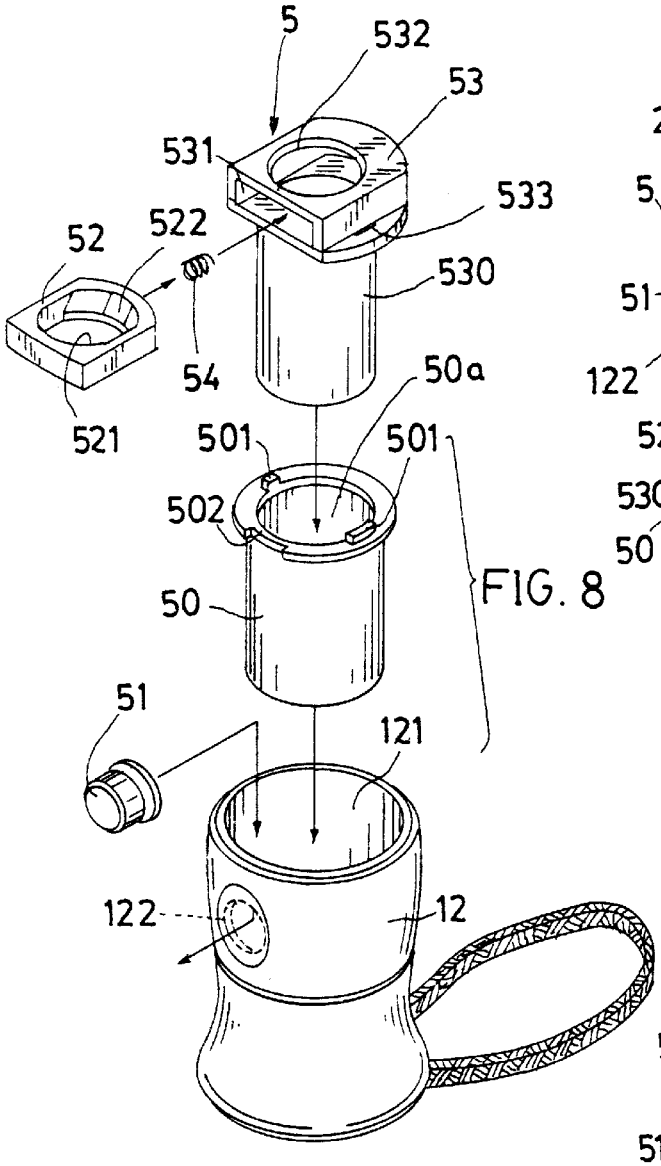
FIG. 8 is a perspective view of another preferred embodiment of the control module and the grip of the present invention.
Figure 9:
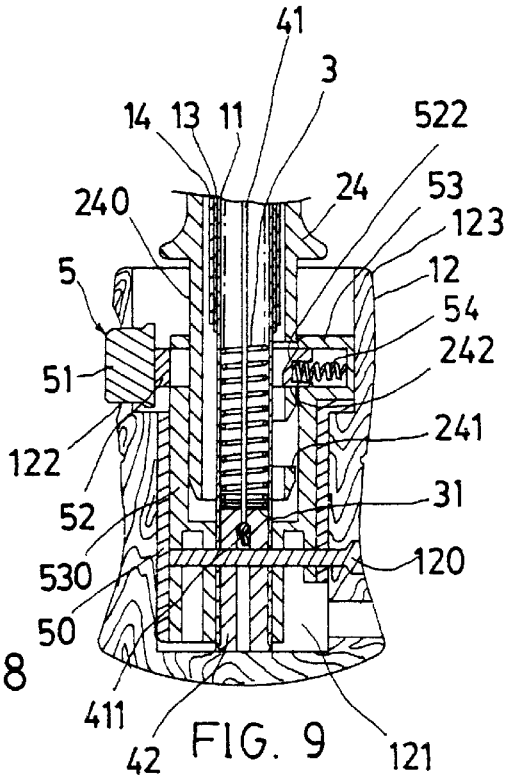
FIG. 9 is a sectional drawing of the grip by assembling the control module of FIG. 8 therein when closing the umbrella.
Figure 10:
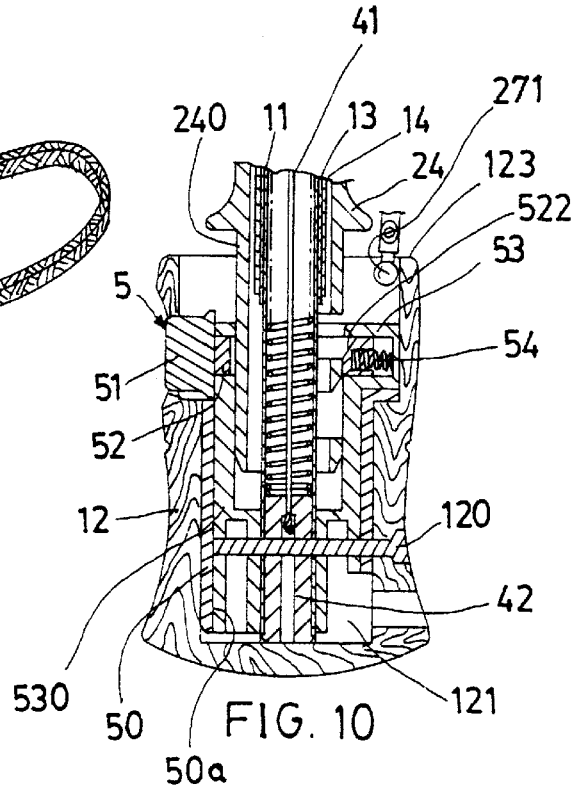
FIG. 10 is a sectional drawing following FIG. 9 by receiving the ball tips within the grip.

The latch holder 53 of the control module 5 of the present invention may be further modified as shown in FIGS. 8~10 for making a wooden grip 12, which includes: a sliding hole 531 transversely formed in an upper end portion of a bushing 530 disposed about a bottom portion of the lower tube 11 in the grip 12, a restoring spring 54 retained in the sliding hole 531 outwardly urging the sliding latch 52 and the push button 51, a central hole 532 longitudinally formed in the latch holder for a downward moving of the lower extension tube 240 of the lower runner 24 when closing the umbrella, and a sleeve member 50 embedded in the interior in the grip 12 and lined between an inside wall of the grip 12 and the bushing 530 of the latch holder 53; with the sleeve member 50 pre-embedded into the interior 121 in the grip 12 for a precise positioning in the grip which is then drilled with a button hole 122 in the grip 12 for slidably holding the push button 51 through the button hole 122, whereby the bushing 530 of the latch holder 53 is then engaged with the sleeve member 50 to align the sliding latch 52 with the push button 51 in the grip 12.

The sleeve member 50 is formed with a pair of lugs 501 on an upper flange of the sleeve member to be engaged with a pair of lug holes 533 diametrically formed in opposite ends of the upper portion of the bushing 530, and a notch 502 recessed in a front portion of the upper flange of the sleeve member 50 to be projectively aligned with the push button for allowing a rearward depression of the push button 51.

The grip 12 as embedded therein with the latch holder 53 and sleeve member 50 is especially recommended for making a wooden grip since all the elements of the control module 5 are made as module units by molding process for an easy embedding, assembly, or detachment in the wooden grip, thereby enhancing the commercial value and decorative effect of an umbrella having wooden grip rather than a plastic grip.

The present invention may be further modified without departing from the spirit and scope of the present invention.

What is claimed is:

1. A lightening multiple-fold automatic umbrella comprising:

a central shaft including a lower tube, a middle tube and an upper tube telescopically engageable with one another, having a grip secured with the lower tube;

a rib assembly having at least a top rib and a stretcher rib pivotally secured to an upper notch on the central shaft and a lower runner slidably held on the central shaft for securing an umbrella cloth on the rib assembly;

an opening spring retained within the central shaft for opening the umbrella;

a drag means retained between the central shaft and the lower runner for pulling the lower runner as upwardly moved when opening the umbrella and extending the rib assembly; and a control module embedded in said grip of the central shaft and normally locking the lower runner when closing the umbrella and folding the rib assembly; and said control module operatively unlocking the lower runner when opening the umbrella and extending the rib assembly; said drag means including: a rope having a lower rope end secured in a rope holder fixed within a lower portion of the lower tube, an upper roller rotatably held in an upper portion of the upper tube, a lower roller rotatably mounted on the lower runner, and an inner sleeve disposed in the upper tube; with said rope directed from said lower rope end through said inner sleeve to be respectively wound on said upper roller, and said lower roller and having an upper rope end secured to an upper portion of said upper tube; and said rope holder of the drag means secured in a bottom portion of the lower tube by a fastening device inserted transversely through the grip for simultaneously fixing the lower tube and a latch holder of the control module within the grip; having a socket formed in the rope holder for passing the lower rope end of the rope through the rope holder to be tied as a knot which is locked within the socket in the rope holder.

2. A multiple-fold automatic umbrella according to claim 1, wherein said control module includes: a push button slidably held in a button hole formed through the grip adjacent to a first side of the central shaft, a sliding latch engageable with at least an engaging hole formed in said lower runner and slidably held in a latch holder embedded in an interior recessed in the grip, and a restoring spring resiliently retained between the sliding latch and the latch holder adjacent to a second side of the shaft for normally urging the sliding latch and the push button resiliently contacted with the sliding latch to protrude the push button outwardly towards the first side of the shaft from the button hole of the grip in order for a depression on the push button when opening the umbrella; said latch holder including: a sliding hole transversely formed in an upper end portion of a bushing disposed about a bottom portion of the lower tube and in the grip, said restoring spring retained in the sliding hole and outwardly urging the sliding latch and the push button, a central hole longitudinally formed in the latch holder for a downward moving of the lower extension tube of the lower runner when closing the umbrella, and a sleeve member embedded in the interior in the grip and lined between an inside wall of the grip and the bushing of the latch holder; and said sleeve member formed with a pair of lugs on an upper flange of the sleeve member to be engaged with a pair of lug holes diametrically formed in opposite ends of an upper portion of the bushing, and a notch recessed in a front portion of the upper flange of the sleeve member to be projectively aligned with the push button for allowing inward depression of the push button.

* * * * *